United States Patent [19]

Weitzner

[11] 4,199,068

[45] Apr. 22, 1980

[54] CONTAINER AND DISPENSING APPARATUS FOR DISPOSABLE DIAPERS

[76] Inventor: Adrienne S. Weitzner, 1901 Hillsdale Pl., Sarasota, Fla. 33578

[21] Appl. No.: 839,657

[22] Filed: Oct. 5, 1977

[51] Int. Cl.[2] ..... A47F 3/024

[52] U.S. Cl. ..... 211/49 D; 312/213

[58] Field of Search ..... 221/242, 312 R, 24, 221/44, 303; 211/50, 49 D, 49 R; 312/50, 213; 271/165, 166, 171, 144; 222/181

[56] References Cited

U.S. PATENT DOCUMENTS

| | | | |
|---|---|---|---|
| 2,301,893 | 11/1942 | Lifshey | 221/242 X |
| 2,858,043 | 10/1958 | Fenton et al. | 271/165 X |
| 3,308,961 | 3/1967 | Chesley | 211/49 D |
| 3,540,631 | 11/1970 | Schmidt | 222/181 |

FOREIGN PATENT DOCUMENTS

| | | | |
|---|---|---|---|
| 403470 | 9/1924 | Fed. Rep. of Germany | 211/50 |

OTHER PUBLICATIONS

*Paper Size Indication*, IBM Technical Disclosure Bulletin, vol. 18, No. 7 (Dec. 1975), D. F. Colglazier et al.

*Primary Examiner*—Stanley H. Tollberg
*Attorney, Agent, or Firm*—Alter and Weiss

[57] ABSTRACT

An improved container and dispensing apparatus for effectively storing and dispensing disposable diapers. The apparatus is formed by a container having a slot release portion as well as adjustment devices for altering its interior dimension to accommodate various sizes of disposable diapers. The apparatus is constructed to enable the user to quickly and easily ascertain the level of diapers within it and may be easily decorated as a toy for unobtrusive incorporation into and utilization in an infant's room.

9 Claims, 7 Drawing Figures

CONTAINER AND DISPENSING APPARATUS FOR DISPOSABLE DIAPERS

BACKGROUND OF THE INVENTION

The present invention relates in general to dispensing and container devices and more particularly to an improved container-dispensing apparatus for effectively storing and dispensing disposable diapers of various sizes.

Only within the last ten years has the utilization of individually packaged disposable diapers for infants come into widespread use. Prior to that time, and to a substantial degree today, parents relied upon diaper service for conventional cloth diapers or went through the inconvenience and labor of washing and maintaining a stock of equivalent cloth diapers.

With the widespread use, availability, and relative low cost of disposable diapers, users of these substantially paper products, though greatly convenienced, have been confronted with problems inherent to the storage and dispensing of such products. Parents for example, have often stored such disposable diaper products in large bulky cartons in closets only to find that, at the most inconvenient time, it was necessary for them to lay the infant down while they ran to get a new sanitary disposable diaper.

Another problem that has arisen with regard to the utilization of such paper products is the availability of the diapers in several sizes to accommodate different purposes. Different sizes of disposable diapers have been manufactured for infants and toddler body sizes, as well as daytime and nighttime thicknesses. With all these and other various sizes and shapes of the diapers, parents have experienced confusion in keeping the diapers properly organized as to type of diaper, have lost diapers in conventional storage areas, such as closets and the like, and have often run into situations where the protective packaging has been torn or ruined, exposing the paper diapers to dirt and germs.

It is thus an object of the present invention to provide a container and dispensing apparatus which may be unobtrusively integrated into an infant's room to appear to be a toy.

It is further an object of the present invention to reduce inadvertent loss or tearing of the disposable diapers and the protective packaging in order to reduce the cost involved with regularly maintaining a stock of disposable diapers.

It is additionally an object of the present invention to provide an apparatus which dispenses the disposable diapers in a facilitated manner and which is yet capable of accommodating any one of a number of various size diapers equally as well.

These and other objects of the invention will become apparent in light of the present specification.

SUMMARY OF THE INVENTION

The present invention is an improved container and dispensing apparatus for effectively storing and dispensing disposable diapers of various sizes. The apparatus comprises: container means, having a top and bottom portion, a front and back portion, and at least two sides respectively adjacent to the front and back, and top and bottom portions to describe a cavity into which the disposable diapers may be stacked and constrained. Slot release means are interposed between the bottom portion and either the sides, or the front or back portions, in order to enable removal of the disposable diapers one at a time from the cavity portion. Means are provided for adjusting the interior dimension of the cavity portion within the container for effectively accommodating and maintaining the disposable diapers of varying size in place in a neatly stacked position for facilitated dispensation from within the cavity portion. Means are also provided for ascertaining the number of non-dispensed disposable diapers remaining within the cavity portion of the container.

As discussed earlier, disposable diapers come in any one of a variety of sizes depending upon the size and age of the infant, or for that matter, depending upon whether the diaper will be used at night while the infant is sleeping, or during the day when more changes of diapers are necessary.

The preferred embodiment of the invention includes apparatus attachment means for securely fastening the disposable diaper-dispensing apparatus to a wall, to a chest of drawers, to a table top, and the like in order to effectively restrain the apparatus as the disposable diapers are dispensed by the user. Such attachment means could comprise a series of wall clamps affixed to the apparatus proximate to the back portion of the container in order to juxtapose the back portion of the apparatus to the wall, chest of drawers, or the table.

The preferred embodiment of the invention further includes the incorporation of release means for facilitating the release and dispensation of the diaper from the apparatus. This release means, preferably, comprises a plurality of rollers proximate to the bottom portion of the container in which the rollers are arranged substantially along a single plane to assist the conveyance of the diaper atop the plane and proximate to the bottom portion, towards and through the slot release means. In this embodiment, one or more of the roller means utilizes a plurality of scored indentations about its respective circumference to accommodate the adjustable attachment of means for adjusting the interior dimension of the cavity portion within the container. The adjustment means are operably attached to the roller means through a plurality of V-shaped adjustment clamps, wherein each of these adjustment clamps comprises a springedly formed strap having a roller aperture therethrough and a pair of free ends.

Each of these V-shaped adjustment straps is capable of alternatively sliding along the roller means when the free ends of the strap are pinched inwardly towards one another and of crimping the roller means at one of the scored identations, so as to be restrained at a desired location along the roller means while allowing rotation of the roller means.

In one embodiment of the invention the means for adjusting the interior dimension of the cavity portions within the container comprises a spacing object which is insertable into the cavity portion between the stack of disposable diapers and one or more of the sides or the back portion to abut the disposable diapers. This spacing object in turn, maintains the diapers in a constrained position proximate to the other side and proximate to the slot release means for facilitated dispensing from the cavity portion. Preferably, the spacing object would take the more appealing shape of a toy so as to be unobtrusive in the apparatus and in turn within an infant's room.

In another embodiment of the invention, the means for adjusting the interior dimension of the cavity portion comprises an adjustable side member interposed between the sides in a plane substantially parallel to the two or more sides. This adjustable side member is adjustable to alternatively increase or reduce the interior cavity portion between the sides and to describe a dimension into which the sides of the disposable diapers will be constrained in place for dispensation, and to in turn maintain the diapers neatly in a stacked configuration proximate to the slot release means. The adjustable side member has means for facilitated adjustment which are capable of maintaining the side member rigidly at a desired position between the sides after the position of the adjustable side member is adjusted.

And yet another embodiment of the invention, the means for adjusting the interior dimension of the cavity portion comprises adjustable back member means in a position between the front and back portions and in a plane substantially parallel to the front and back portions. The adjustable back member is adjustable to alternatively increase or reduce the interior cavity portion between the front and back portion to describe a dimension into which the front and back of the disposable diapers will be constrained in place for dispensation and to maintain the diapers neatly in place in a stacked configuration. As with the adjustable side members, the adjustable back members have means for facilitated adjustment which are capable of maintaining the back member rigidly at a desired position between the front and back portions after the position of the back member is adjusted.

The preferred embodiment of the invention further includes fabrication of the apparatus with the front, back, and sides comprising a plurality of bar members in parallel arrangement respectively. One or more of the sides utilize rail means for adjustable attachment of the adjustment means for adjusting the interior dimension of the cavity portion. The plurality of bar members forming the front, back, and side members are capable of exposing the interior cavity portion of the apparatus as well as the disposable diapers contained therein to a user thereby enabling the user to ascertain the number of non-dispensed disposable diapers remaining within the cavity portion of the container.

Further, the plurality of bar members provides the ability to the apparatus of being easily decorated or disguised as a toy, such as a circus wagon as shown in the drawings for unobtrusive utilization in an infants room.

The means for adjusting the interior dimension of the cavity portion are attached to, and cooperate with, the rail means through a plurality of V-shaped adjustment clamps similar to those described for utilization with the roller means proximate the bottom portion of the apparatus container. Each of the adjustment clamps comprises a springedly formed V-shaped strap having a rail aperture therethrough, and a pair of free ends. Each of the V-shaped adjustment straps is capable of sliding about the rail means when the free ends of the strap are pinched inwardly or is capable of rigidly crimping the rail means when the free ends are released, to exert spring tension about the rail means to thereby alternatively enable movement of the back portion or securely restrained positioning of the back portion as desired. In a like manner, it should be realized that the dimensions of the slot release means may be made adjustable to accommodate various thicknesses of the diapers depending upon the various type of disposable diaper contained within the apparatus, while limiting the number of diapers capable of withdrawal from the cavity portion during a single dispensation.

In yet another embodiment of the invention also, the means for ascertaining the number of non-dispensed disposable diapers comprises the utilization of a slotted opening in one or more of the front and back portion and/or side portions through which an amount of the contained diapers may be viewed by a user. Through such a slot type opening, the top portion of the apparatus may be enclosed to reduce contamination of the diapers contained within the apparatus. Alternatively, the top portion of the apparatus may be opened to provide facilitated access to the interior cavity portion and to similarly provide means for ascertaining the number of non-dispensed disposable diapers remaining within the apparatus.

BRIEF DESCRIPTION OF THE DRAWINGS

FIG. 7 is an enlarged side perspective view of the attachment means utilized in combination with the apparatus for attaching the dispenser to a wall and the like.

DETAILED DESCRIPTION

Figure 1:
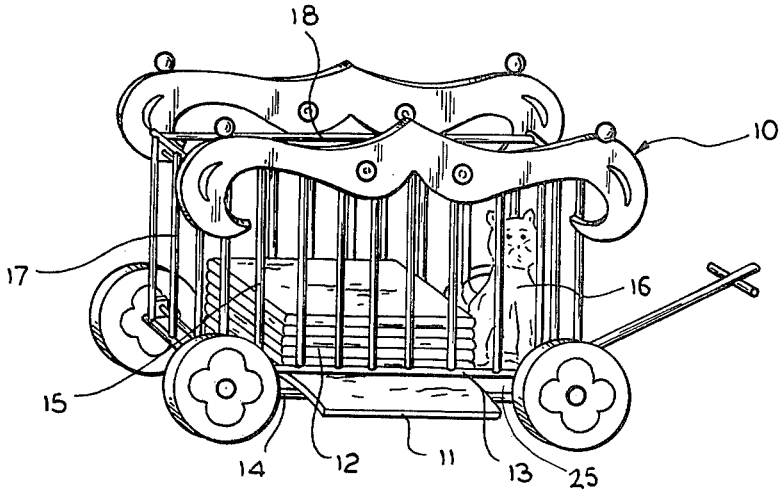
FIG. 1 of the drawings is a side perspective view of one embodiment of the disposable diaper dispensing apparatus, showing placement and positioning of the stacked diapers within the cavity portion of same.

While this invention is susceptible of embodiment in many different forms, there is shown in the drawings and will herein be described in detail, several specific embodiments, with the understanding that the present disclosure is to be considered as an exemplification of the principles of the invention and is not intended to limit the invention to the embodiments illustrated.

Disposable-diaper dispensing apparatus 10, is shown in FIG. 1, in its simplest embodiment wherein front portion 15 meets side 17 and bottom portion 14. Between front portion 15 and bottom portion 14 are slot entry means 25 through which disposable diapers such as diaper 11 may be dispensed one at a time with front portion 15 maintaining the remaining stack of diapers in place within the dispenser for future dispensation. In this particular embodiment, top portion 18 is open and the front and rear portions, bottom portion, and sides are constructed in a configuration of bars to permit viewing of the interior so as to ascertain the number of remaining disposable diapers for refilling.

When the stack of remaining diapers 12 is depleted to a certain extent, additional disposable diapers may be placed into the container for subsequent use. Through such a fabrication in which bars are utilized, it should be readily apparent that the device may be camouflaged and its design enhanced through the addition of members which convert the dispenser into a toy for unobtrusive installation and utilization in an infants room. Spacing object 16 is utilized to maintain stacked diapers 12 in a neatly stacked configuration within the cavity portion of the container and may be placed, as shown, between one of the sides and the sides of the stacked diapers, and/or may be placed between the back portion and the back side of the diapers to further exert a force against the diapers so as to maintain them in close proximity to the slot release means 25.

In the preferred embodiment spacing object 16 is shaped into a toylike object or plaything so as to be as unobtrusive as the container apparatus itself.

Figure 2:
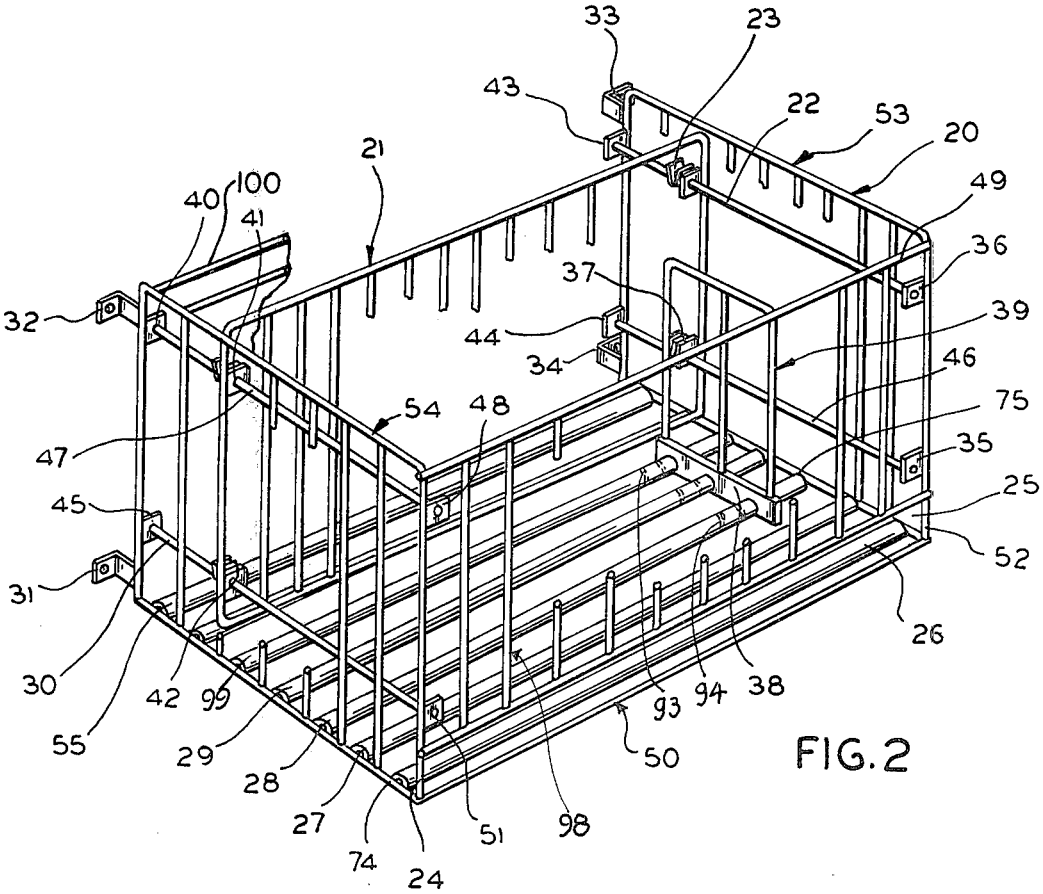
FIG. 2 is a side perspective view of a preferred embodiment of the invention, particularly illustrating the various means for adjusting the dimensions of the cavity portion.

Another preferred embodiment of the invention is shown in FIG. 2 in which dispensing apparatus 20 is formed by sides 53 and 54, front portion 98, bottom portion 50, back portion 21 and a top portion which, in this case has been left substantially opened. Slot release means 25 is formed between the position of front portion 98 and bottom portion 50. The slot release means are further interposed between the front portion and the sides of the apparatus. Further, bottom portion 50, in this embodiment, utilizes a plurality of rollers such as rollers 27, 28, 29, and 55 for the purposes of facilitating the dispensing of disposable diapers from within the cavity portion of the apparatus.

Apparatus brackets 31 through 34 are utilized for securely fastening the dispensing apparatus 20 to a wall or other equivalent plane. Placement of the attachment means could be made on the bottom of bottom side 50 for equivalent attachment to a horizontal planer surface. Rails 22, 46, 30 and 47 are affixed to sides 53 and 54 to provide adjustable attachment of back member 21 forming the back portion of the device to snuggly constrain the edges of the disposable diapers maintained within the container for facilitated dispensing thereof.

Figure 3:
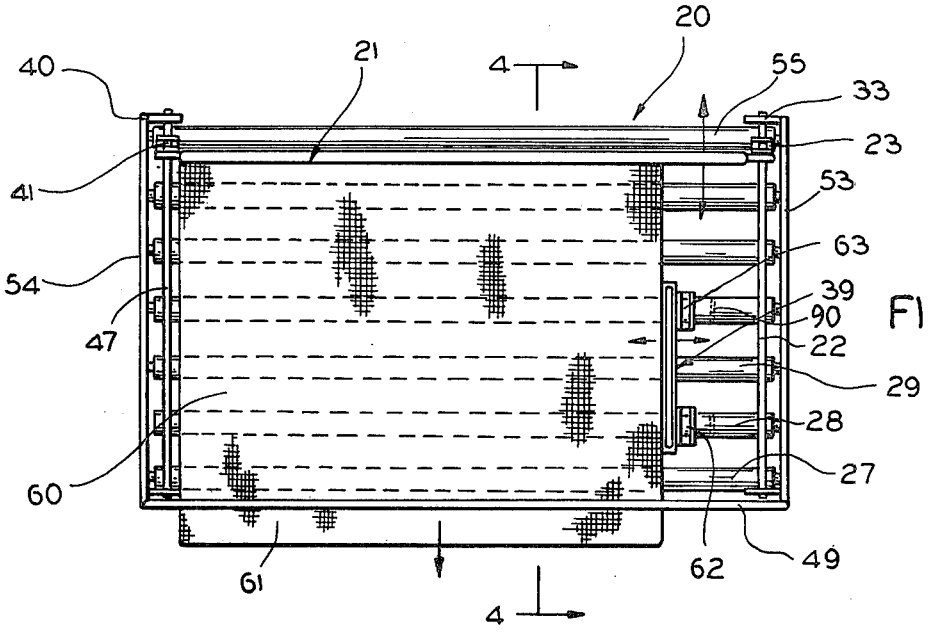
FIG. 3 is a top plan view of the dispensing apparatus and disposable diapers contained therein, as one such diaper is dispensed from the device.

Members 36 and 43, and 35 and 44 on side 53 provide for the attachment of rails 22 and 46 respectively, and members 40 and 48, and 45 and 51 on side 54 provide means for the attachment of rails 47 and 30 on side 54. Through such an arrangement, back member 21 can slide towards and away from front portion 98 through the utilization of the V-shaped clamping apparatus 23, 37, 41, and 42. Means are also provided, in this preferred embodiment, for adjusting the dimension of the container cavity between sides 53 and 54. Adjustable side member 39 is connected by member 38 to enable sliding to any one of a number of positions along rollers 28, 29, and 99. Each of these rollers for example, utilizes a series of notches such as notch 94 in roller 28 and notch 93 in roller 99, into which a V-shaped adjustment clamp rides to restrain the longitudinal position of adjustable side member 39 while allowing the rotation of the rollers for facilitated dispensing of the disposable diaper. These V-shaped clamps for utilization with the adjustable side member are shown in FIG. 3 by reference numerals 62 and 63 proximate to notches such as notch 90. Optional cover member 100 is also shown.

A top plan view of the dispensing apparatus 20 is shown in FIG. 3 as having V-shaped clamps 23 and 41 sliding on rails 22 and 47 respectively. The edge views of sides 53 and 54 are shown as is the edge view of backside 21 which, in this embodiment comprises the adjustable back member.

Facilitated release means comprising rollers 27, 28, 29, and 55 facilitate the dispensing of diaper 61 as it is dispensed in the direction of the arrow. Depending upon the size of the slot release means and thus the dimension of front portion 49, a remaining stack of diapers 60 is maintained within the cavity portion of the container for subsequent dispensing. It should be noted that the stack of diapers themselves or the box containing the diapers as packaged by the manufacturer may alternatively be maintained within the cavity position for dispensing of the diapers. As is readily apparent, adjustable side member 39 together with adjustable back member 21 closely constrains the plurality of stacked diapers 60 into a desired area of the container 20 and maintains them proximate to the slot release means for neat and facilitate dispensing.

Figure 4:
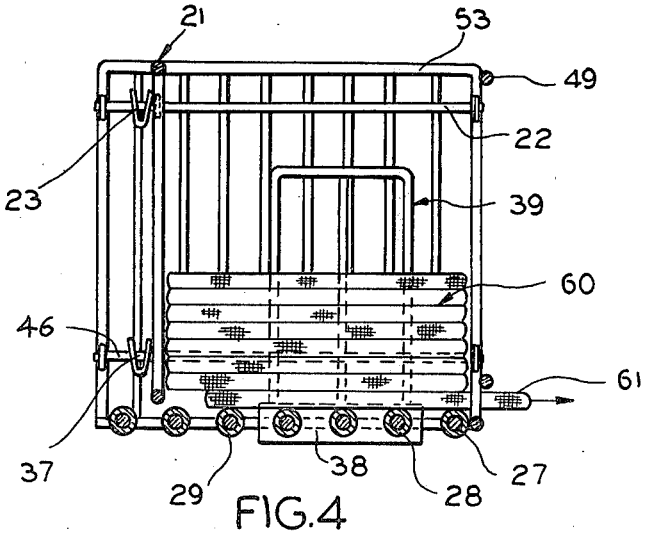
FIG. 4 is a partial cross sectional view taken along lines 4—4 of FIG. 3 and looking in the direction of the arrows, illustrating, in detail, the construction of the apparatus including the adjustable side member.

Member 38 of adjustable side member 39 is shown in greater detail in FIG. 4 saddling several of the rollers such as roller 28, to enable adjustable side member 39 to closely and securely maintain diapers 60 in a stacked configuration together with adjustable back member 21. As also shown in FIG 4, while V-shaped members 23 and 37 can be attached directly to adjustable rear member 21 to maintain it in place, portions of adjustable member 21 can be interposed between the two extending sides of clamps 23 and 37 to maintain adjustable member 21 between the confines of the interior portion of the V-shaped clamps with virtually identical results. Through such an arrangement, pinching of the clamps would permit movement of the back member 21 along rails 22 and 46.

Figure 5:
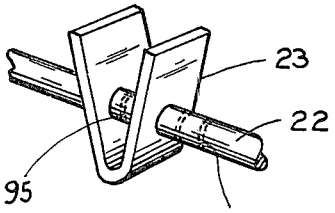
FIG. 5 is an enlarged view of the adjustable clamp means utilized with rails or rollers in order to adjust the dimensions of the interior cavity portion.

An enlarged view of the adjustable V-shaped clamp 23 is shown in FIG. 5 in which clamp 23 is in position about rail 22. Pinching the ends of clamp 23 together enables sliding to occur with respect to rail 22, to in turn provide the adjustment feature discussed regarding, for example, the adjustable back member. An equivalent manner of operation is involved with the utilization of similar V-shaped clamps about rollers. In such an operation, wherein the adjustable side member would be adjusted, the V-shaped clamp would settle into one of several provided notches such as notches 91 or 95 shown in dashed lines on rail 22, for the express purpose of maintaining the longitudinal position of V-shaped clamp 23 while permitting rotation of the roller within the aperatures of the clamp itself.

Figure 6:
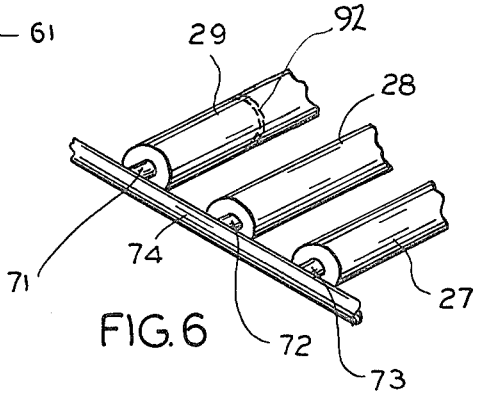
FIG. 6 is an enlarged side perspective view of the rollers utilized on the bottom portion of the apparatus.

Notch 92 in roller 29 of FIG. 6, more clearly shows utilization of the notches in combination with the roller means for the aforementioned co-operation with the V-shaped clamp. Bar member 74 communicates with rollers 27 through 29 through the utilization of axle members 73, 72, and 71 respectively.

Figure 7:
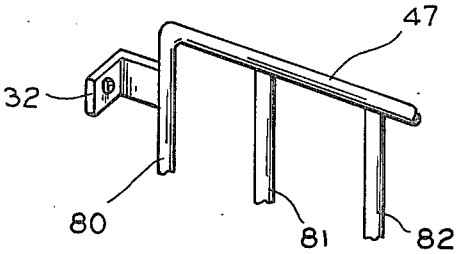

In FIG. 7, a portion of side 47 is shown having attached thereto brackets 31–34 for subsequent and facilitated attachment of the dispensing apparatus to a wall or equivalent structure.

The foregoing description and drawings merely explain and illustrate the invention and the invention is not limited thereto, except insofar as the appended claims are so limited, as those skilled in the art who have the disclosure before them will be able to make modifications and variations therein without departing from the scope of the invention.

What is claimed is:

1. An improved container and dispensing apparatus for effectively storing and dispensing disposable diapers of various sizes, said apparatus comprising:

container means defined by a top and bottom portion, a front and back portion and at least two sides respectively adjacent said front and back and said top and bottom portions so as to describe a cavity portion in which said disposable diapers may be stacked and constrained;

slot release means interposed between said bottom portion and one or more of said side, front and back portions to enable removal of said disposable diapers one at a time from said cavity portion;

means for adjusting the interior dimension of said cavity portion within said container means for effectively accommodating and maintaining disposable diapers of varying size in place, neatly stacked, for facilitated dispensation from within said cavity portion;

means for ascertaining the number of non-dispensed disposable diapers remaining within said cavity portion of said container means;

additional release means for facilitating the release and dispensation of said diaper from said apparatus, said additional release means comprising a plurality of roller means proximate to said bottom portion, said roller means arranged substantially along a single plane and assisting the conveyance of said disposable diaper atop said plane toward and through said slot release means;

one or more of said roller means having a plurality of scored indentations about its respective circumference to accommodate the adjustable attachment of said means for adjusting the interior dimension of said cavity portion within said container means, said means for adjusting the interior dimension being operably attached to said roller means through a plurality of V-shaped adjustment clamps, each said adjustment clamp comprising a springedly formed strap having a roller aperture therethrough and a pair of free ends, each of said V-shaped adjustment straps being capable of alternatively sliding along said roller means when said free ends of said strap are pinched inwardly towards one another, and said adjustment strap crimping about said roller means at one of said scored indentations so as to be simultaneously restrained at a desired location along said roller means while allowing rotation of said roller means.

2. The improved container and dispensing apparatus of claim 1 in which the invention further comprises:

apparatus attachment means for securely fastening said apparatus to a wall or other object so as to effectively restrain said apparatus as said disposable diapers are dispensed by a user.

3. The invention according to claim 2 in which said wall attachment means comprises:

a series of wall brackets affixed to said apparatus proximate to said back portion in order to juxtapose said back portion of said container means to said wall or object.

4. The invention according to claim 1 in which said means for adjusting the interior dimension of said cavity portion further comprises:

an adjustable back member interposed between said front and back portions in a plane substantially parallel to said front and back portions;

said adjustable back member being adjustable so as to alternatively increase or reduce the interior cavity portion between said front and back portions thereby describing a dimension into which the front and back of said disposable diapers will be constrained in place for dispensation and to maintain said diapers neatly in said stacked configuration;

said adjustable back member having means for facilitated adjustment which are capable of maintaining said back member rigidly at a desired position between said front and back portions after the position of said adjustable back member is adjusted.

5. The invention according to claim 1 in which each of said front and back portions, and sides comprises:

a plurality of bar members in parallel arrangement respectively;

one or more of said sides having rail means attached thereto for adjustable attachment of said means for adjusting the interior dimension of said cavity portion, said plurality of bar members forming said front and back portions and sides, exposing said interior cavity portion and said disposable diapers contained therein to a user thereby enabling said user to ascertain the number of non-dispensed disposable diapers remaining with said cavity portion of said container means, said plurality of bar members further providing to said apparatus the ability of being easily decorated as a toy for unobtrusive utilization in an infant's room.

6. The invention according to claim 1 in which said means for ascertaining the number of non-dispensed disposable diapers comprises:

a slotted opening in one or more of said front and back portions, and sides, through which an amount of contained diapers may be viewed by a user.

7. The invention according to claim 1 in which said top portion is substantially open.

8. The invention according to claim 1 in which said top portion is substantially enclosed by a top member cover.

9. An improved container and dispensing apparatus for effectively storing and dispensing disposable diapers of various sizes, said apparatus comprising:

container means defined by a top and bottom portion, a front and back portion and at least two sides respectively adjacent said front and back and said top and bottom portions so as to describe a cavity portion in which said disposable diapers may be stacked and constrained;

slot release means interposed between said bottom portion and one or more of said side, front and back portions to enable removal of said disposable diapers one at a time from said cavity portion;

means for adjusting the interior dimension of said cavity portion within said container means for effectively accommodating and maintaining disposable diapers of varying size in place, neatly stacked, for facilitated dispensation from within said cavity portion;

means for ascertaining the number of non-dispensed disposable diapers remaining within said cavity portion of said container means;

each of said front and back portions and sides comprising a plurality of bar members in parallel arrangement respectively;

one or more of said sides having rail means attached thereto for adjustable attachment of said means for adjusting the interior dimension of said cavity portion;

said plurality of bar members forming said front and back portions and sides, exposing said interior cavity portion and said disposable diapers contained therein to a user thereby enabling said user to ascertain the number of non-dispensed disposable diapers remaining within said cavity portion of said container means, said plurality of bar members further providing to said apparatus the ability of being easily decorated as a toy for unobtrusive utilization in an infant's room;

said means for adjusting the interior dimension of said cavity portion attached to and cooperating with said rail means through a plurality of V-shaped adjustment clamps, each said adjustment clamp comprising a springedly formed strap having a rail aperture therethrough and a pair of free ends;

each of said V-shaped adjustment straps being capable of sliding about said rail means when the free ends of said strap are pinched inwardly towards one another, and said V-shaped adjustment strap rigidly crimping said rail means when said free ends are released to exert spring tension about said rail means thereby alternatively enabling movement of said back portion and securely restrained positioning of said back portion as desired.

* * * * *